US008981963B2

(12) United States Patent
Emura et al.

(10) Patent No.: US 8,981,963 B2
(45) Date of Patent: Mar. 17, 2015

(54) ACCIDENT/NEAR-MISS FACTOR AREA SPECIFYING DEVICE AND ACCIDENT/NEAR-MISS FACTOR AREA SPECIFYING METHOD

(75) Inventors: Koichi Emura, Kanagawa (JP); Hayashi Ito, Chiba (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 51 days.

(21) Appl. No.: 13/822,874

(22) PCT Filed: Sep. 16, 2011

(86) PCT No.: PCT/JP2011/005247

§ 371 (c)(1), (2), (4) Date: Mar. 13, 2013

(87) PCT Pub. No.: WO2012/042776

PCT Pub. Date: Apr. 5, 2012

(65) Prior Publication Data

US 2013/0181850 A1 Jul. 18, 2013

(30) Foreign Application Priority Data

Oct. 1, 2010 (JP) ..... 2010-223889

(51) Int. Cl.

*G08G 1/09* (2006.01)
*G08G 1/0967* (2006.01)
*G08G 1/16* (2006.01)

(52) U.S. Cl.

CPC ..... *G08G 1/0967* (2013.01); *G08G 1/16* (2013.01)
USPC ..... 340/905

(58) Field of Classification Search

USPC ..... 340/905, 995.1, 995.17, 435, 436; 701/301
See application file for complete search history.

(56) References Cited

U.S. PATENT DOCUMENTS 6,940,423 B2 * 9/2005 Takagi et al. ..... 340/932.2
2002/0115423 A1 8/2002 Hatae et al.

(Continued)

FOREIGN PATENT DOCUMENTS

JP 2003-078654 A 3/2003
JP 2005-165555 * 6/2005

(Continued)

OTHER PUBLICATIONS

International Search Report for PCT/JP2011/005247 dated Nov. 8, 2011.

(Continued)

*Primary Examiner* — Phung Nguyen
(74) *Attorney, Agent, or Firm* — Pearne & Gordon LLP

(57) ABSTRACT

Disclosed is an accident/near-miss factor area specifying device capable of specifying accident/near-miss factor areas, the presentation of which is highly required. The accident/near-miss factor area specifying device (100) is used for specifying accident/near-miss factor areas which a driver of a vehicle should be aware of in order to prevent an accident, and the device comprises a viewing area specifying unit (151) for specifying a viewing area of a driver of a vehicle which had a near-miss, immediately before the near-miss occurs, and an unnoticed area specifying unit (152) wherein, when a near-miss object is located in a viewing area, an area corresponding to the position of the object is treated as an unnoticed area which is one of the accident/near-miss factor areas.

10 Claims, 16 Drawing Sheets

(56) References Cited

U.S. PATENT DOCUMENTS

| | | | | |
|---|---|---|---|---|
| 2007/0120657 | A1* | 5/2007 | Schofield et al. | 340/435 |
| 2010/0208374 | A1* | 8/2010 | Yinko et al. | 359/863 |
| 2010/0289632 | A1* | 11/2010 | Seder et al. | 340/436 |
| 2014/0098231 | A1* | 4/2014 | Buley et al. | 348/148 |

FOREIGN PATENT DOCUMENTS

| | | | |
|---|---|---|---|
| JP | 2005-165555 | A | 6/2005 |
| JP | 2008-041058 | A | 2/2008 |
| JP | 2008-046766 | A | 2/2008 |
| JP | 2009-104531 | A | 5/2009 |
| JP | 2010-083205 | A | 4/2010 |

OTHER PUBLICATIONS

Society of Osaka Traffic Science "Traffic Safety Science—Theory and Practice of Novel Traffic Safety, Chapter 2, Attention and Safety at the Time of Driving" Company Development Center Traffic Issue Laboratory, Feb. 2000, pp. 231-241.

Kishiro Sawa "Traffic Safety Overview (Revised Edition), Chapter 2: Speed and Human Physical Limit, Section 5: Speed and Limit of Visibility" Seizando-Shoten Publishing Co., Ltd., Jan. 2002, pp. 60-65.

Kazuma Ishimatu and Toshiaki Miura "Influence of Aging on Effective Visual Field (Mainly on Traffic Safety), Chapter 2: Effective Visual Field" Proceedings of Human Science Department of Osaka University Graduate School, vol. 28, Mar. 2002, pp. 17-18.

* cited by examiner

ACCIDENT/NEAR-MISS FACTOR AREA SPECIFYING DEVICE AND ACCIDENT/NEAR-MISS FACTOR AREA SPECIFYING METHOD

TECHNICAL FIELD

The present invention relates to an incident/potential-incident factor area specifying apparatus and an incident/potential-incident factor area specifying method of specifying an incident/potential-incident factor area as an area to be noticed by the driver of a vehicle in order to prevent an incident and a potential-incident.

BACKGROUND ART

Incident prediction information and incident statistic/analysis information are useful to prevent a vehicle incident. Such information is provided to, for example, the driver of a vehicle, a road administrator who performs safety design of a road and examines an improvement plan, a police officer who makes an inspection of a traffic incident and a traffic safety campaign, an incident appraiser and an insurer conducting an incident analysis, and the like.

It is said that about 40 percent of traffic incidents occur due to delay in perception or a mistake in judgment on a danger without avoidance behavior. With respect to following driving in a single road, various safety driving support techniques to address inattention to the front of drivers are developed.

For example, an active safety system mounted on a car is one of such techniques. The system measures the distance to a driving vehicle or a pedestrian in front by using a millimeter-wave radar or a laser radar. The system always monitors whether safe distance is maintained according to drive speed or not on the basis of the measured distance and, when the vehicle comes too close, gives warning to the driver.

At an intersection where traffic is heavy, a driver has to disperse visual attention in a wide range. Consequently, a system which monitors only the front as described above cannot sufficiently support safety driving. Many of traffic incidents occur in intersections. For example, about 60% (about 70% in big cities) of traffic incidents in Japan occur in and around intersections. Therefore, also on driving in intersections, a technique for supporting safety driving is demanded.

For example, Patent Literature 1 discloses a dangerous place display system which estimates the courses of vehicles and displays an area predicted to be crossed by the courses as a dangerous area so as to be overlapped on map data.

For example, Patent Literature 2 discloses a notifying system, when an oncoming vehicle located in a blind spot of a vehicle which turns right in an intersection is present, of notifying the driver on the vehicle turning right of the presence of the oncoming vehicle.

In the conventional techniques, an area (hereinbelow, called "incident/potential-incident factor area" or simply "factor area") having high possibility of an incident or a state (hereinbelow, called "potential incident") very close to an incident in an intersection is specified and presented. That is, the conventional techniques can support safety driving in intersections. In the case where an incident or a potential incident occurs in reality, the conventional techniques can support a subsequent work of finding the cause by the police or the like using a record of the position and time of occurrence of a blind spot.

CITATION LIST

Patent Literature

PTL 1
Japanese Patent Application Laid-Open NO. 2005-165555
PTL 2
Japanese Patent Application Laid-Open NO. 2008-41058

Non-Patent Literature

NPL 1
Society of Osaka traffic Science "Traffic Safety Science—Theory and Practice of Novel Traffic Safety, Chapter 2, Attention and Safety at the time of Driving", Company Development Center Traffic Issue Laboratory, February 2000, p. 231-241
NPL 2
Kishiro Sawa, "Traffic Safety Overview (Revised Edition), Chapter 2: Speed and Human Physical Limit, Section 5: Speed and Limit of Visibility", Seizando-Shoten Publishing Co., Ltd., January, 2002, p. 60-65
NPL 3
Kazuma Ishimatu and Toshiaki Miura "Influence of Aging on Effective Visual Field (Mainly on Traffic Safety), Chapter 2: Effective Visual Field", Proceedings of Human Science Department of Osaka University Graduate School, Vol. 28, March 2002, p. 17-18

SUMMARY OF INVENTION

Technical Problem

The conventional techniques, however, present even an area to which most of drivers originally pay attention and in which an incident or a potential incident does not actually occur and therefore have a problem that the presentation makes information users such as the drivers feel bothersome. When an area is presented regardless of the degree of necessity of presentation, attention of the driver to an incident/potential-incident factor area decreases and the cause becomes complicated, so that a cause investigating work becomes more complicated. Therefore, it is desirable to specify an area which is likely to be a factor of an incident or potential incident, that is, an incident/potential-incident factor area which has to be presented.

An object of the present invention is to provide an incident/potential-incident factor area specifying apparatus and an incident/potential-incident factor area specifying method capable of specifying an incident/potential-incident factor area having great need for presentation.

Solution to Problem

According to the present invention, an incident/potential-incident factor area specifying apparatus that specifies one or more incident/potential-incident factor areas to be noticed by a driver of a vehicle in order to prevent an incident and a potential incident, includes: a viewing area specifying section that specifies a viewing area of the driver of the vehicle just before occurrence of an incident or a potential incident that has occurred with the vehicle; and an unnoticed area specifying section that, if an object of the incident or the potential incident is located in the viewing area, sets an area corresponding to a location of the object, as an unnoticed area that is one of the incident/potential-incident factor areas.

According to the present invention, an incident/potential-incident factor area specifying method of specifying one or more incident/potential-incident factor area to be noticed by a driver of a vehicle in order to prevent an incident and a potential-incident, includes: a step of specifying a viewing area of the driver of the vehicle just before occurrence of an incident or a potential incident that has occurred with the vehicle; and a step, if an object of the potential incident is located in the viewing area, of setting an area corresponding to a location of the object, as an unnoticed area that is one of the incident/potential-incident factor areas.

Advantageous Effects of Invention

According to the present invention, it is possible to specify an incident/potential-incident factor area having need of presentation.

DESCRIPTION OF EMBODIMENTS

Hereinafter, embodiments of the present invention will be described in detail with reference to the drawings.

Embodiment 1

Figure 1:
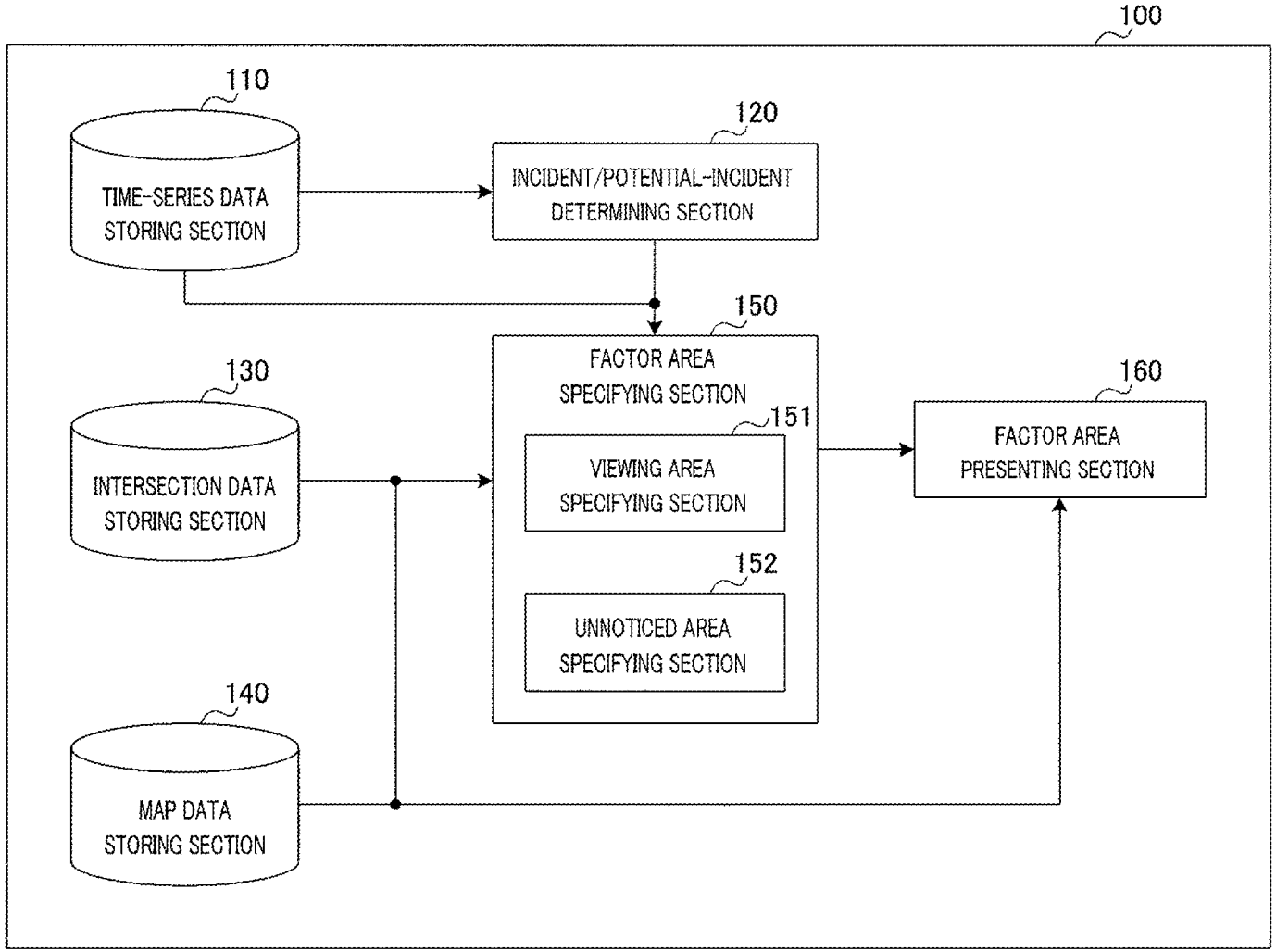
FIG. 1 is a block diagram illustrating an example of the configuration of an incident/potential-incident factor area specifying apparatus according to Embodiment 1 of the present invention.

FIG. 1 is a block diagram illustrating an example of the configuration of an incident/potential-incident factor area specifying apparatus according to Embodiment 1 of the present invention.

In FIG. 1, incident/potential-incident factor area specifying apparatus 100 has time-series data storing section 110, incident/potential-incident determining section 120, intersection data storing section 130, map data storing section 140, factor area specifying section 150, and factor area presenting section 160.

Time-series data storing section 110 stores time-series data as record of driving situations of a plurality of vehicles. The driving situation includes at least, for example, the position and orientation (or velocity vector) of each vehicle since the vehicle enters an intersection until it goes out from the intersection in a predetermined period (past one year or the like). That is, from the time-series data, the speed, acceleration, and course of each vehicle which enters an intersection can be specified at each time. The time-series data is obtained by analyzing, for example, information of a drive recorder provided in a vehicle, information collected from a smart number plate of a driving vehicle at an intersection, and the like. It is assumed that the time-series data is preliminarily stored in time-series data storing section 110.

Incident/potential-incident determining section 120 determines whether or not an incident or potential incident occurs in any of the vehicles on the basis of the time-series data stored in time-series data storing section 110. Incident/potential-incident determining section 120 specifies the place of occurrence of an incident or potential incident, occurrence time, and an object of the incident or potential incident. The object of the incident or potential incident refers to, basically, any or any combination of a vehicle, a motorcycle, a bicycle, or a pedestrian as the other side, i.e., the cause of the incident or potential incident of the vehicle. In some cases, the object of the incident or potential incident refers to a falling object, a construction area a curbstone, a signboard, or the like.

In the present embodiment, to simplify explanation, only a vehicle is handled as an object of an incident or potential incident. A vehicle as a reference for specifying a factor region will be called a "first vehicle", and another vehicle as the other side of an incident or potential incident which may occur with the first vehicle will be called a "second vehicle". Among the second vehicles, a vehicle as the other side of an incident or potential incident which actually occurs with the first vehicle is called an "object of an incident or potential incident".

Intersection data storing section 130 stores intersection data of each of intersections. The intersection data is information of a geometric shape of an intersection, incidental facilities, the positions and sizes of buildings in the periphery, and the like, i.e., information describing the structure of the intersection. It is assumed that the intersection data is, for example, obtained from an information server via the Internet and is pre-stored in intersection data storing section 130.

Map data storing section 140, stores map data of each intersection. It is assumed that the map data is obtained from, for example, an information server via the Internet and is pre-stored in map data storing section 140.

Factor area specifying section 150 specifies a factor area having high possibility as a factor of occurrence of a potential incident which occurs in the first vehicle and having great need of presentation (hereinbelow, called "factor area to be presented"). Factor area specifying section 150 has viewing area specifying section 151 and unnoticed area specifying section 152.

Viewing area specifying section 151 specifies, in time unit, a viewing area corresponding to the visual field of the driver of the first vehicle (hereinbelow, simply called "viewing area") in a predetermined period immediately before the time of occurrence of a potential incident. The viewing area is defined as the geographical area according to the field of view of the driver. The specification is performed since a time point just before the first vehicle enters an intersection until a time point when a potential incident occurs on the basis of positions and orientations in time units.

Unnoticed area specifying section 152 determines that the second vehicle is an object of an incident/potential incident if the second vehicle is located in the viewing area of the first vehicle since the time point just before the first vehicle enters an intersection until the time point of occurrence of a potential incident. In the viewing area, the region on the inside of lines connecting both ends of the second vehicle which can be viewed from the first vehicle and the first vehicle will be called an "unnoticed area" to which the driver of the first vehicle does not pay attention. That is, the unnoticed area is an area which is in the area of the visual field to which the driver can pay attention but does not actually pay attention. The unnoticed area is defined as the geographical area where the driver did not pay attention to.

Factor area presenting section 160 obtains map data of the place of occurrence of a potential incident from map data storing section 140. Factor area presenting section 160 displays the unnoticed area as the incident/potential incident factor area to be noticed more so as to be overlapped on the map data.

Incident/potential-incident factor area specifying apparatus 100 has, although not illustrated, for example, a CPU (Central Processing Unit), a storing medium such as an RAM (Random Access Memory), an operation section made by a plurality of key switches and the like, and a display section made by a liquid crystal display or the like. In this case, each of the function sections is implemented by the CPU executing a control program.

Incident/potential-incident factor area specifying apparatus 100 configured as described above can specify an incident/potential-incident factor area having great need of presentation from the relation between the position of the incident/potential-incident object and the viewing area of the driver. That is, incident/potential-incident factor area specifying apparatus 100 can specify an area corresponding to the position of the incident/potential-incident object existing in the viewing area of the driver just before occurrence of a potential incident, as an area which can be seen but is not actually seen by the driver. Incident/potential-incident factor area specifying apparatus 100 can set the area as an unnoticed area which is one of the incident/potential-incident factor areas.

A viewing area and an unnoticed area in the present embodiment will now be described.

Figure 2:
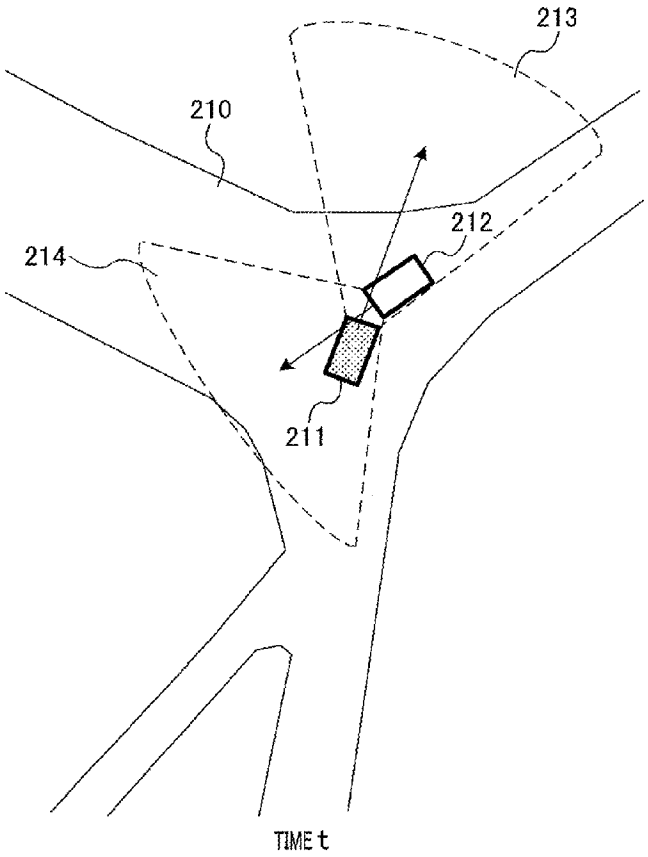
FIG. 2 is a first schematic view for explaining a viewing area and an unnoticed area in Embodiment 1.
Figure 3:
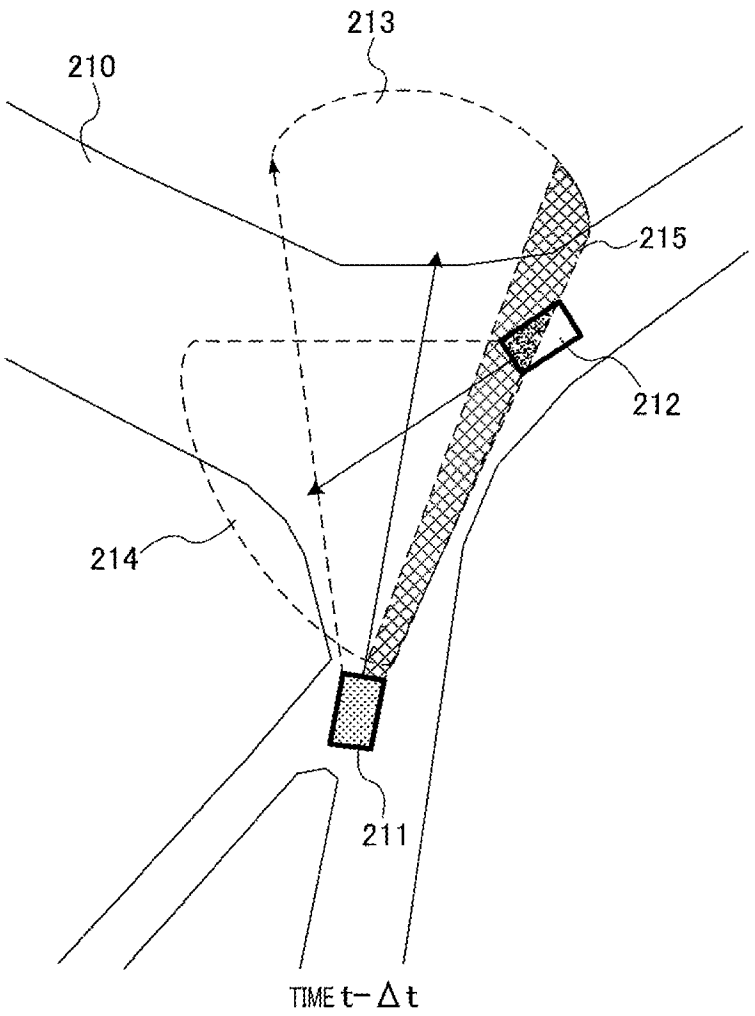
FIG. 3 is a second schematic view for explaining a viewing area and an unnoticed area in Embodiment 1.

FIGS. 2 and 3 are schematic views for explaining a viewing area and an unnoticed area. FIG. 2 illustrates a state at time "t" when a potential incident occurs between first and second vehicles. FIG. 3 is a diagram illustrating a viewing area and an unnoticed area of each of the vehicles at time t−Δt just before a potential incident occurs.

In the example illustrated in FIG. 2, it is assumed that a potential incident occurs between first vehicle 211 and second vehicle 212 (vehicles 211 and 212 come close to collision) in intersection 210. Second vehicle 212 is an object of an incident/potential incident. As described above, although first vehicle 211 is determined as a vehicle as a reference for specifying the incident/potential-incident factor area, the opposite situation can be applied. That is, when second vehicle 212 is determined as a vehicle as a reference for specifying the incident/potential-incident factor area, first vehicle 211 can be the incident/potential-incident object for second vehicle 212.

First viewing area 213 corresponding to the effective visual field of the driver of first vehicle 211 extends in the travel direction of first vehicle 211. Viewing area 214 corresponding to the effective visual field of the driver of second vehicle 212 extends in the travel direction of second vehicle 212. In Non-Patent Literature 3, the effective visual field is defined as a peripheral area of points of regard in which a perceiver can retrieve, discriminate, process or store information on a given issue. In the present embodiment, the effective visual field is defined as an area in which the driver can notice the presence of a vehicle when the driver pays attention.

As illustrated in FIG. 2, second vehicle 212 is located in first viewing area 213. Therefore, when the driver of first vehicle 211 notices the presence of second vehicle 212 at the earliest possible timing before a potential incident, there is a high possibility that the potential incident can be prevented. In other words, in spite of the fact that second vehicle 212 was located in first viewing area 213, there is a high possibility that the driver of first vehicle 211 did not pay attention to second vehicle 212.

As illustrated in FIG. 3, if second vehicle 212 is located in first viewing area 213 at time t−Δt immediately before a potential incident, incident/potential-incident factor area specifying apparatus 100 sets an area corresponding to the location of second vehicle 212, as unnoticed area 215. Incident/potential-incident factor area specifying apparatus 100 presents unnoticed area 215 as an incident/potential incident factor area which is highly likely to be a factor of a potential incident.

The operations of incident/potential-incident factor area specifying apparatus 100 will now be described.

Figure 4:
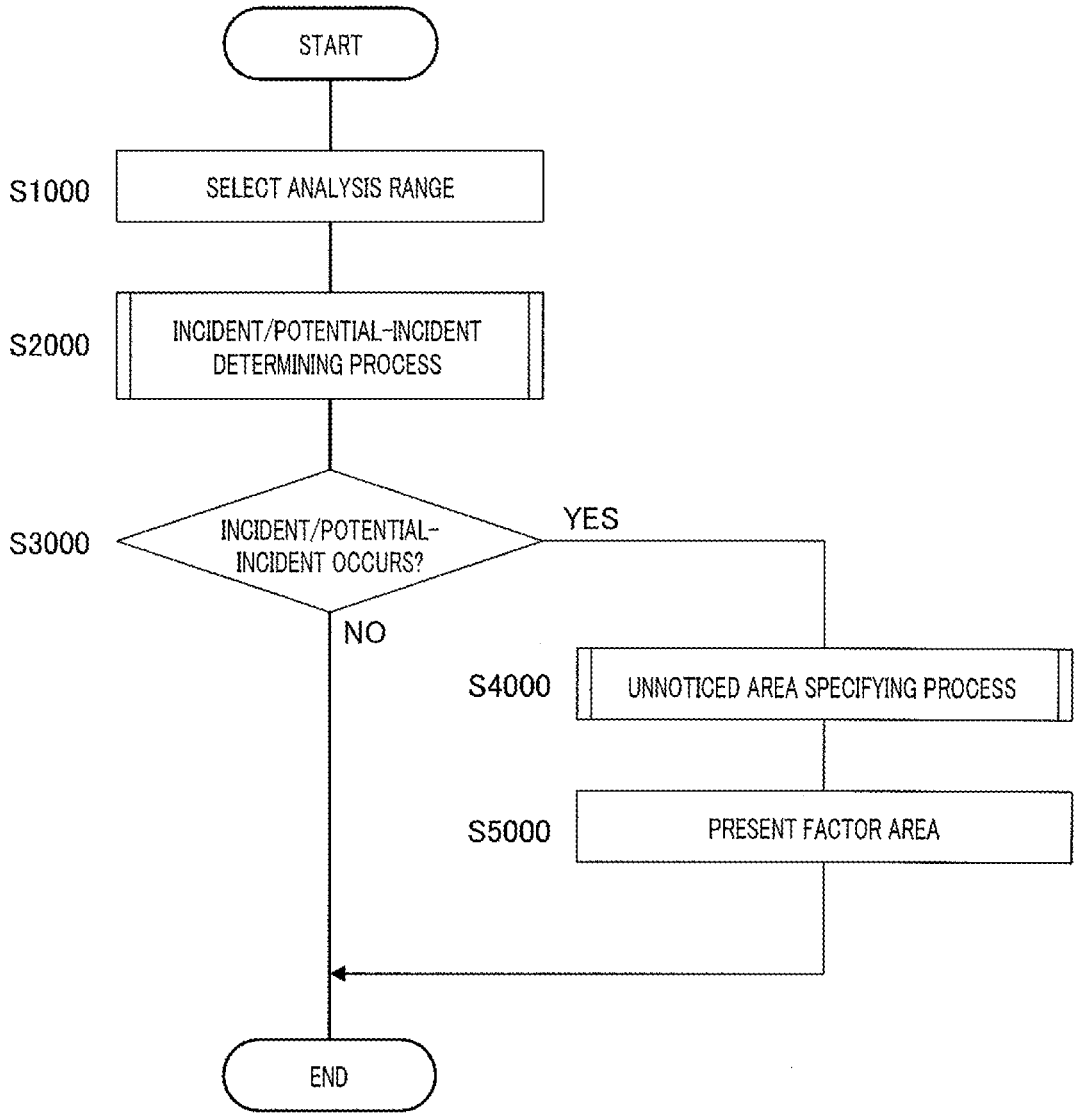
FIG. 4 is a flowchart showing an example of operations of the incident/potential-incident factor area specifying, apparatus according to Embodiment 1.

FIG. 4 is a flowchart showing an example of operations of incident/potential-incident factor-area specifying apparatus 100.

First, in step S1000, incident/potential-incident determining section 120 selects the range of performing analysis for specifying the incident/potential-incident factor area. For example, when a specific intersection, date, and time zone are designated by operation of an operator or the like, incident/potential-incident determining section 120 selects time-series data corresponding to a designated object as an analysis object. Incident/potential-incident factor area specifying apparatus 100 may execute the processes in steps S2000 to S5000 to be described later only for a designated first vehicle. Incident/potential-incident factor area specifying apparatus 100 may handle, as first vehicles, all of vehicles which enter an intersection as an analysis object within a time zone as an analysis object, and execute the processes in steps S2000 to S5000 for each of the first vehicles.

In step S2000, incident/potential-incident determining section 120 executes an incident/potential-incident determining process for determining whether a potential incident occurs in the selection object or not. The details of the process will be described later.

In step S3000, factor area specifying section 150 determines whether a potential incident occurs or not. If a potential incident occurs (YES in S3000), factor area specifying section 150 proceeds to step S4000.

In step S4000, factor area specifying section 150 executes an unnoticed area specifying process of specifying an unnoticed area. The details of the process will be described later.

In step S5000, on the basis of they incident/potential-incident factor area, factor area presenting section 160 obtains map data of an intersection where a potential incident occurs, from map data storing section 140. Factor area presenting section 160 displays the incident/potential-incident factor area so as to be overlapped on the obtained map data. The state of the display screen is as illustrated in, for example, FIG. 3.

Figure 5:
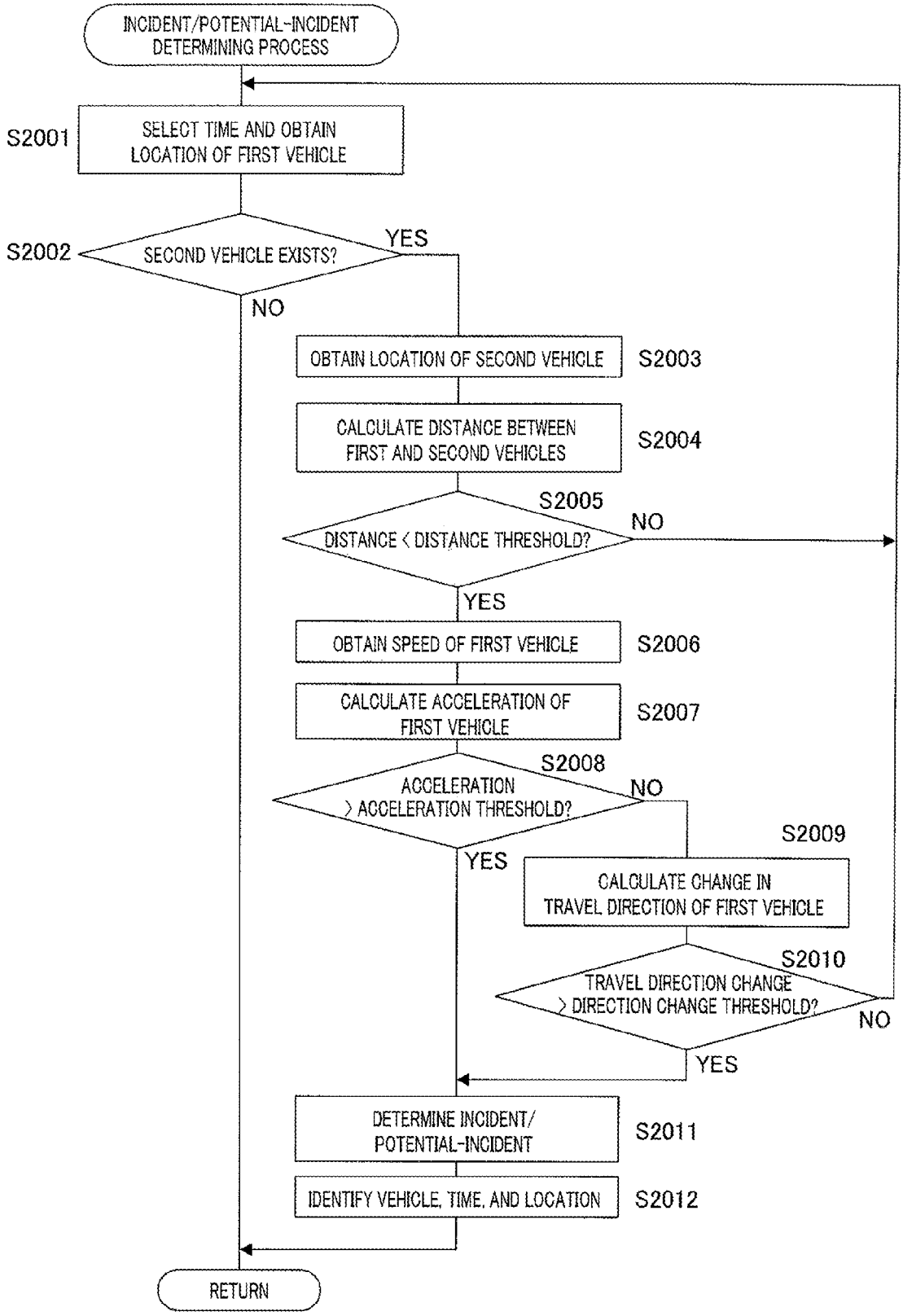
FIG. 5 is a flowchart showing an example of incident/potential-incident determining process in Embodiment 1.

FIG. 5 is a flowchart showing an example of the incident/potential-incident determining process (step S2000) in Embodiment 1.

First, incident/potential-incident determining section 120 selects one time in a time zone to be analyzed from time-series data to be analyzed and obtains the location of the first vehicle at the time (S2001). Incident/potential-incident determining section 120 determines whether the second vehicle exists or not at the selected time (S2002).

It is now assumed that incident/potential-incident determining section 120 handles a vehicle which encounters with the first vehicle in any intersection and at any time as a second vehicle. Each time another first vehicle enters an intersection, incident/potential-incident determining section 120 handles a vehicle which encounters with the first vehicle as a second vehicle. The same vehicle may be a second vehicle for a different first vehicle. To simplify the description, it is assumed that at most one second vehicle exists as an analysis object. If two or more second vehicles exist at the same time, incident/potential-incident determining section 120 may execute the processes in steps S2002 to S2012 to be described later for each of the detected second vehicles.

If the second vehicle exists at selected time (YES in S2002), incident/potential-incident determining section 120 obtains the location of the second vehicle at the selected time from the time-series data to be analyzed (S2003). Incident/potential-incident determining section 120 calculates the distance between the first and second vehicles at the selected time (S2004).

Incident/potential-incident determining section 120 determines whether the calculated distance is shorter than a predetermined distance threshold or not (S2005). If the calculated distance is shorter than the distance threshold (YES in S2005), incident/potential-incident determining section 120 obtains the speed at each of time of the first vehicle in a predetermined time range before and after the selected time from the time-series data to be analyzed (S2006). From the obtained speed of the time series, incident/potential-incident determining section 120 calculates acceleration of the first vehicle at the selected time (S2007).

Incident/potential-incident determining section 120 determines whether the calculated acceleration is equal to or less than a predetermined acceleration threshold or not (S2008). If the calculated acceleration is equal to or less than the acceleration threshold (NO in S2008), incident/potential-incident determining section 120 proceeds to step S2009. Incident/potential-incident determining section 120 obtains the travel direction (orientation) at each time of the first vehicle in the predetermined time range before and after the selected time from the time-series data to be analyzed (S2009). Incident/potential-incident determining section 120 determines whether a change in the travel direction is larger than a predetermined direction change threshold or not from the obtained travel direction in the time series (S2010).

If the acceleration is larger than the acceleration threshold (YES in S2008), incident/potential-incident determining section 120 proceeds to step S2011. If the change in the travel direction is larger than the direction change threshold (YES in S2010), incident/potential-incident determining section 120 proceeds to step S2011. Incident/potential-incident determining section 120 determines whether at least one of the condition that the acceleration is larger than the acceleration threshold and the condition that the change in the travel direction is larger than the direction change threshold is satisfied or not. When at least one of the two conditions is satisfied, incident/potential-incident determining section 120 determines that a potential incident occurs (S2011). Incident/potential-incident determining section 120 identifies the first vehicle as an object for specifying the incident/potential-incident factor area, and identifies the second vehicle as an incident/potential-incident object. Incident/potential-incident determining section 120 identifies the selected time as potential-incident occurrence time and identifies the intersection where the first vehicle is located at the selected time, as a potential-incident occurrence location (S2012). Incident/potential-incident determining section 120 outputs identification results to factor area specifying section 150 and returns to the processes in FIG. 4.

If the calculated distance is shorter than the distance threshold at the selected time (NO in S2005), incident/potential-incident determining section 120 returns to step S2001. If the acceleration is equal to or less than the acceleration threshold and the travel direction change is equal to or less than the direction change threshold (NO in S2008 and NO in S2010), incident/potential-incident determining section 120 returns to step S2001. Incident/potential-incident determining section 120 designates the next time from the analysis object and repeats the process. If no second vehicle exists in the analysis object (NO in S2002), incident/potential-incident determining section 120 returns to the process of FIG. 4.

Figure 6:
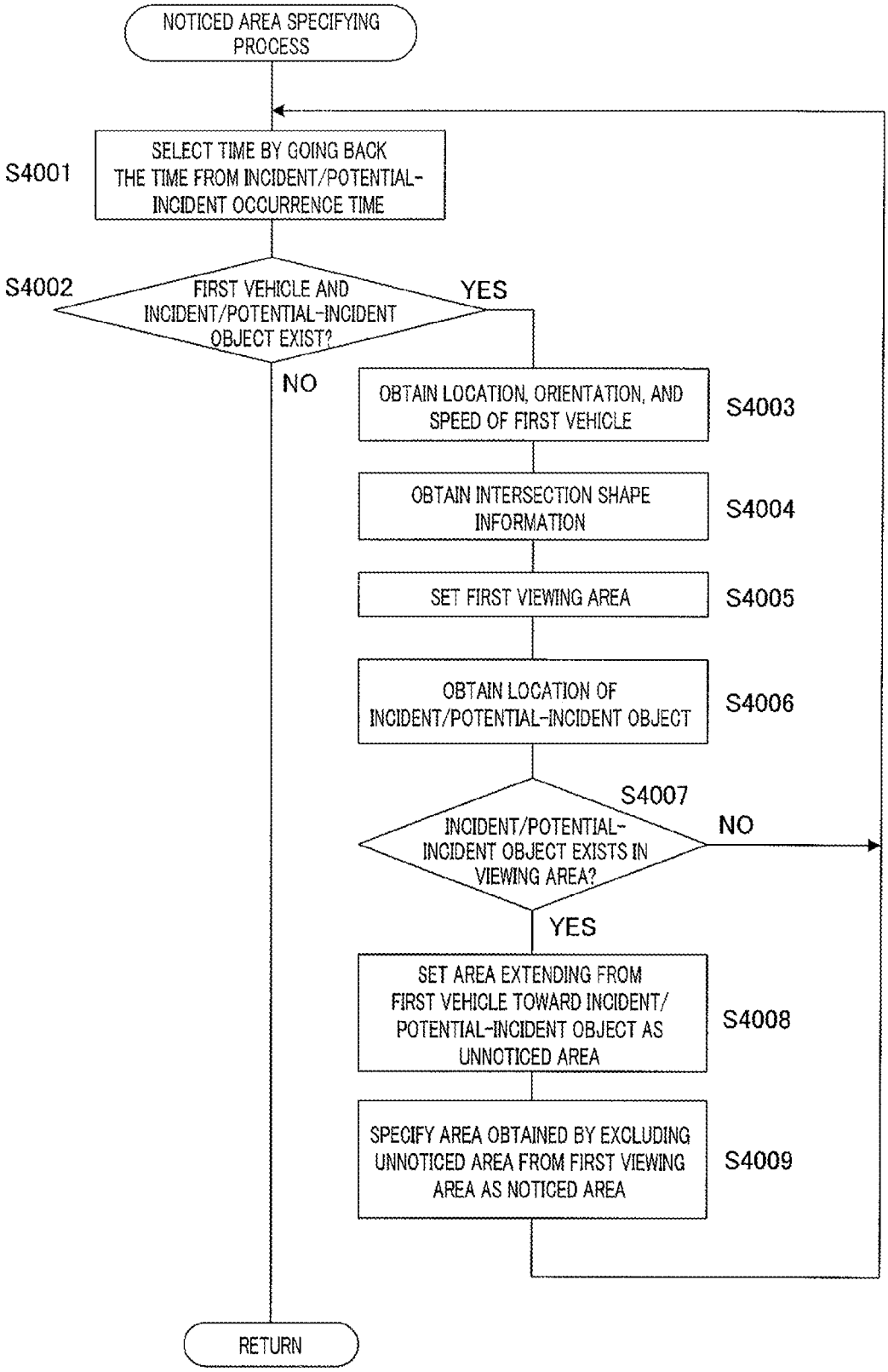
FIG. 6 is a flowchart showing an example, of unnoticed area specifying process in Embodiment 1.

FIG. 6 is a flowchart showing an example of the unnoticed area specifying process (step S4000).

First, factor area specifying section 150 selects time by going back the time from the potential-incident occurrence time "t" by a predetermined time interval (S4001). Factor area specifying section 150 determines whether or not both the first vehicle and the incident/potential-incident object exist in the intersection as the potential-incident occurrence location at the selected time (S4002). While both of the first vehicle and the incident/potential-incident object exist in the intersection as the potential-incident occurrence location (YES in S4002), factor area specifying section 150 repeats the processes in following steps S4003 to S4009. That is, the processes in the steps S4003 to S4009 are repeated until at least one of the first vehicle and the incident/potential-incident object does not exist in the intersection.

In step S4003, factor area specifying section 150 obtains the position, travel direction (orientation) and speed of the first vehicle at the selected time from the time-series data (S4003). Factor area specifying section 150 obtains intersection shape information of an intersection as the potential-incident occurrence location from the intersection data stored in intersection data storing section 130 (S4004).

Factor area specifying section 150 sets a first viewing area (area corresponding to the effective visual field of the driver of the first vehicle) at the selected time from the position, travel direction, and speed, which are obtained, of the first vehicle (S4005). Preferably, factor area specifying section 150 excludes a blind area which cannot be seen from the driver of the first vehicle, from the first viewing area on the basis of the geometric shape of the intersection, incidental facilities, the positions and sizes of buildings, and the like.

Factor area specifying section 150 sets the first viewing area in accordance with the visual feature of a human being.

For example, as described in Non-Patent Literature 1, the sensitivity of the retina of a human being is high only in the center portion. More specifically, the range in which resolution is high and close to eyesight measured in an eye test is 2° around the point of regard (the range of 35 cm around the point of regard in location 10 m ahead). The sensitivity decreases to 20% of that in the center, in distance apart from the center by 10°. The effective visual field, is usually the range of about 4° to 20° in the peripheral visual field around the central vision and changes according to a psychological factor.

For example, as described in Non-Patent Literature 2, the dynamic vision of a moving human being decreases significantly with advancing age, and decreases as the walking speed of a human being or moving speed of an object increases. The dynamic vision of a moving human being is the eyesight when he/she who is moving sees a moving object. The dynamic visual field is narrowed as the walking speed of a human being increases, like the dynamic vision. The dynamic visual field is a range which can be seen by a human being who is moving without changing the position of his/her eyes.

On the basis of the visual feature, for example, factor area specifying section 150 sets, as the first viewing area, a fan-shaped area which opens at predetermined angle θ in the direction of the velocity vector of the first vehicle around the position of the first vehicle as a center (the blind area may be excluded). Factor area specifying section 150 defines, for example, the angle θ of the fan shape as following equation 1 using the maximum value 20° of the effective visual field and velocity "v" of the first vehicle.

$$\theta(v)=-1e^{-5}\times v^3-0.0007\times v^2+0.0008\times v+20 \quad \text{(Equation 1)}$$

Subsequently, factor area specifying section 150 obtains the position of an incident/potential-incident object at selected time from time-series data (S4006) and determines whether or not an incident/potential-incident object exists in the set first viewing area (S4007). If an incident/potential-incident object does not exist in the first viewing area (NO in S4007), factor area specifying section 150 returns to step S4001, designates the next time, and repeats the process.

If an incident/potential-incident object exists in the first viewing area (YES in S4007), the process proceeds to step S4008. Factor area specifying section 150 sets, as an unnoticed area, an area on the inside of a line segment connecting the position of the first vehicle and the positions at both ends of the second vehicle which is an incident/potential-incident object and which can be visually recognized from the first vehicle (S4008). Factor area specifying section 150 may set, as an unnoticed area, the entire area extending in a direction from the position of the first vehicle toward the position of an incident/potential-incident object, in the first viewing area. Alternately, factor area specifying section 150 may set, as an unnoticed area, only the area up to the area in which the incident/potential-incident object is located, in the direction from the position of the first vehicle toward the position of an incident/potential-incident object.

Factor area specifying section 150 specifies, as a noticed area, an area obtained by excluding the unnoticed area from the first viewing area (S4009). After that, factor area specifying section 150 returns to step S4001, designates the next time, and repeats the process. Factor area specifying section 150 may specify, as a noticed area, an area obtained by excluding the unnoticed area and an over-noticed area from the first viewing area.

If any of the first vehicle and the incident/potential-incident object does not exist in the intersection as the potential-incident occurrence location (NO in S4002), factor area specifying section 150 specifies the incident/potential-incident factor area on the basis of the set unnoticed area.

Factor area specifying section 150 may set the unnoticed area at each time as the incident/potential-incident factor area at the time. Factor area specifying section 150 may set an area obtained through the logical OR operation on the unnoticed areas at respective time points in a continuous time zone, as the incident/potential-incident factor area in a time zone just before a potential incident. Factor area specifying section 150 may set an area obtained through the logical OR operation on the unnoticed areas at respective time points in discrete time points or time zones (for example, the same time point or time zone in different days), as an incident/potential-incident factor area in a time zone just before a potential incident. Factor area specifying section 150 may set, as an incident/potential-incident factor area, an area where a time integral of a time period of the existence of the unnoticed area in a continuous time zone or in discrete time points or time zones is a predetermined value or larger. Factor area specifying section 150 may set, as an incident/potential-incident factor area in a time zone just before a potential incident, only the unnoticed area at any time.

Factor area specifying section 150 outputs a specified incident/potential-incident factor area to factor area presenting section 160 and returns to the process of FIG. 4. At this time, factor area specifying section 150 also outputs the occurrence time of a potential incident, the position and orientation of the first vehicle and the incident/potential-incident object at each time, and a noticed area to factor area presenting section 160. The result is displayed by factor area presenting section 160 in such a manner that the incident/potential-incident factor area is overlapped on the map data of the intersection where the potential incident occurs. Factor area presenting section 160 may display only a portion overlapping a road area as the incident/potential-incident factor area with reference to the structure data of the intersection. Further, factor area presenting section 160 may display, as an incident/potential-incident factor area, only a portion which does not overlap the building area and incidental facilities such as a footbridge with reference to data on a building in the periphery of the intersection.

As described above, if the incident/potential-incident object is located in the viewing area of the driver of the vehicle immediately before a potential incident, incident/potential-incident factor area specifying apparatus 100 according to the present embodiment presents the unnoticed area corresponding to the location of the incident/potential-incident object, as an incident/potential-incident factor area. In such a manner, an incident/potential-incident factor area which is likely to be a factor of a potential incident and having great need of presentation is specified, and a presentation object can be narrowed to such an area. That is, incident/potential-incident factor area specifying apparatus 100 can call for attention or present a potentially dangerous area with respect to a potential incident caused by paying no attention to an incident/potential-incident object even though the object exists in the effective visual field. Therefore, presentation of even an area which is not likely to be a factor of a potential incident can be prevented, and troublesomeness of an information user such as a driver can be reduced.

Embodiment 2

The area which is likely to be a factor of a potential incident includes not only the unnoticed area described in Embodiment 1 but also an "area noticed more than necessary". For example, in the case where the driver has to pay more attention to a second vehicle as an incident/potential-incident object which comes from the right direction but pays too much attention to another third vehicle which comes from the left direction, an area in the left direction is an area to which attention is paid more than necessary. That is, the area in the left direction is an area as a factor of a potential incident.

The incident/potential-incident factor area specifying apparatus according to Embodiment 2 of the present invention sets the area to which attention is paid more than necessary as an "over-noticed area", and presents the unnoticed area and the over-noticed area as incident/potential-incident factor areas. The over-noticed area is defined as the geographical area where the driver paid over-attention to.

Figure 7:
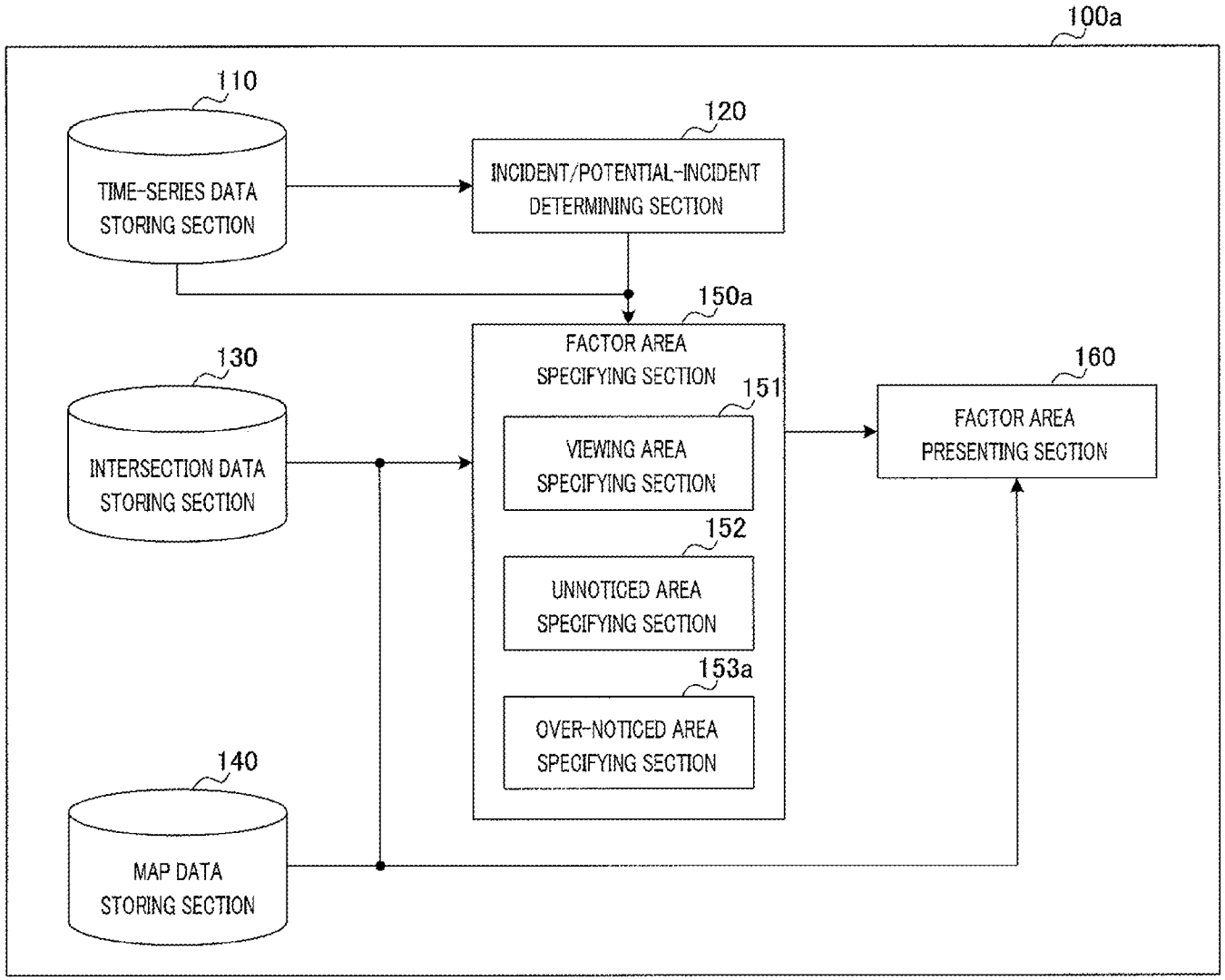
FIG. 7 is a block diagram illustrating an example of the configuration of an incident/potential-incident factor area specifying apparatus according to Embodiment 2 of the present invention.

FIG. 7 is a block diagram illustrating an example of the configuration of an incident/potential-incident factor area specifying apparatus according to Embodiment 2 of the present invention, and corresponds to FIG. 1 in Embodiment 1. The same reference numerals are designated to the same parts as those of FIG. 1, and their description will not be repeated.

In FIG. 7, factor area specifying section 150*a* of incident/potential-incident factor area specifying apparatus 100*a* according to the present embodiment newly has over-noticed area specifying section 153*a*.

If another object which is likely to be noticed by the driver of the first vehicle is located in the first viewing region except for the incident/potential-incident object, over-noticed area specifying section 153*a* sets the area corresponding to the location of the object, as an over-noticed area. Over-noticed area specifying section 153*a* outputs the over-noticed area as an incident/potential-incident factor area to factor area presenting section 160.

Figure 8:
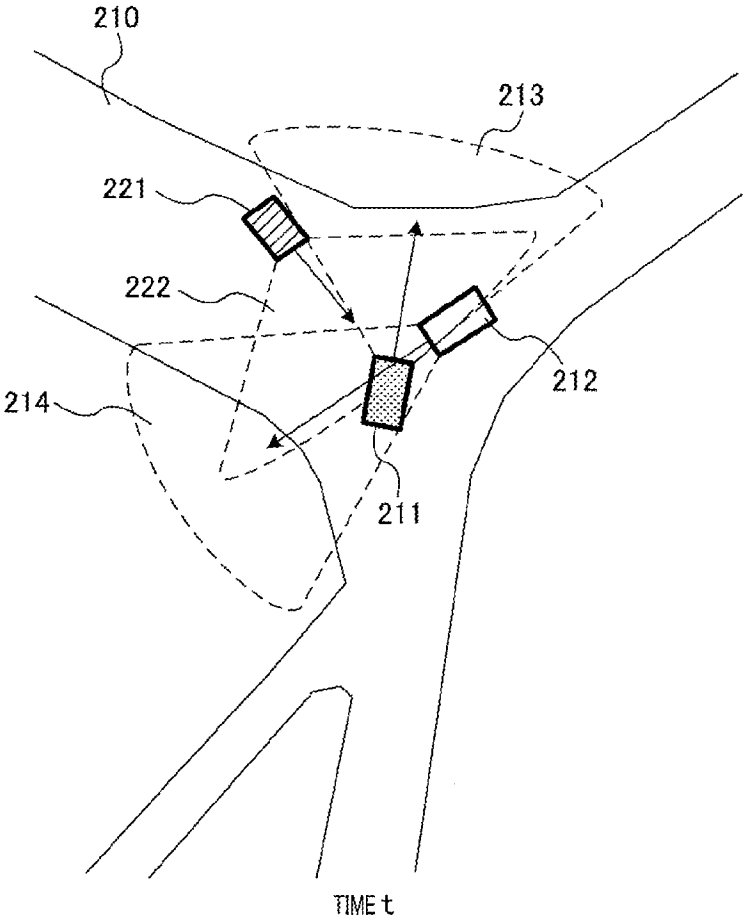
FIG. 8 is a first schematic view for explaining an over-noticed area in Embodiment 2.
Figure 9:
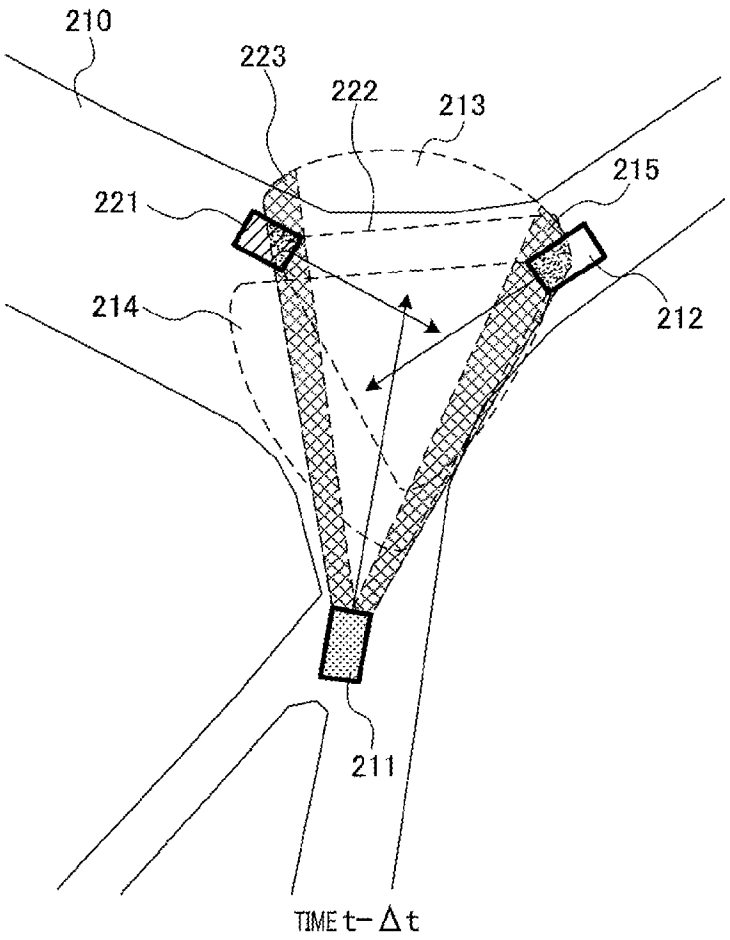
FIG. 9 is a second schematic view for explaining an over-noticed area in Embodiment 2.

FIGS. 8 and 9 are schematic views for explaining an over-noticed area and correspond to FIGS. 2 and 3 of Embodiment 1. The same reference numerals are designated to the same components as those of FIGS. 2 and 3, and their description will not be repeated.

As illustrated in FIGS. 8 and 9, viewing area 222 corresponding to the effective visual field of the driver of third vehicle 221 extends in the travel direction of first vehicle 211. At time t−Δt just before time "t" when a potential incident between first and second vehicles 211 and 212 occurs, third vehicle 221 is located in a direction different from unnoticed area 215 in first viewing area 213. The possibility that the driver of first vehicle 211 pays too much attention to third vehicle 221 just before a potential incident with second vehicle 212 and does not notice the presence of second vehicle 212 is high.

In the present embodiment, it is assumed that third vehicle 221 as a vehicle which is not an incident/potential-incident object (hereinbelow, called an "over-noticed object") is located in first viewing area 213 at time t−Δt just before a potential incident. Over-noticed area specifying section 153*a* sets, as over-noticed area 223, the area corresponding to the location of third vehicle 221. Factor area presenting section 160 presents also over-noticed area 223 as the incident/potential-incident factor area.

Figure 10:
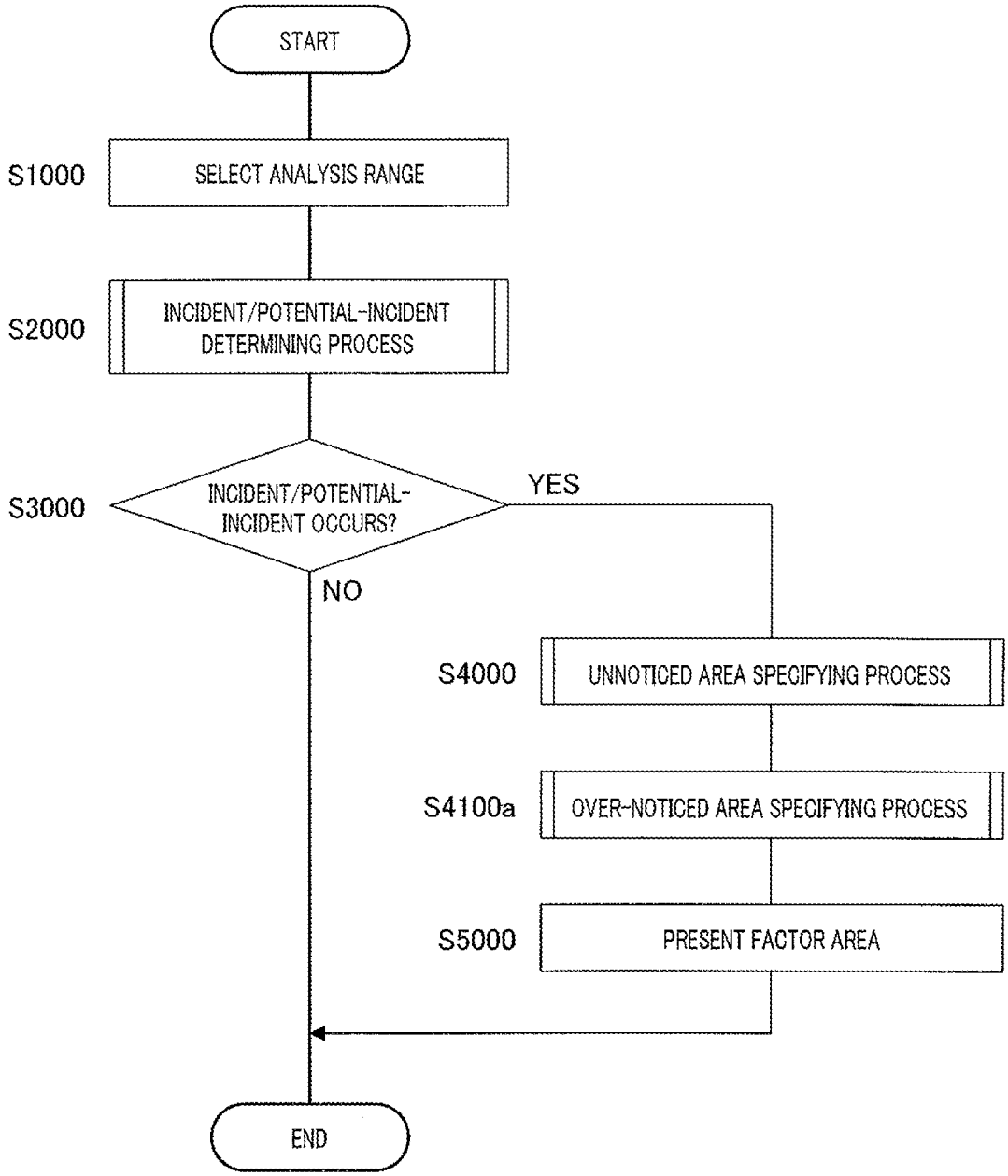
FIG. 10 is a flowchart showing an example of operations of the incident/potential-incident factor area specifying apparatus according to Embodiment 2.

FIG. 10 is a flowchart showing an example of operations of incident/potential-incident factor area specifying apparatus 100*a* according to the present embodiment and corresponds to FIG. 4 of Embodiment 1. The same reference numerals are designated to the same components as those of FIG. 4, and their description will not be repeated.

If the unnoticed area is specified in step S4000, over-noticed area specifying section 153*a* executes an over-noticed area specifying process of specifying an over-noticed area in step S4100*a*. The details of the process will be described later.

In the present embodiment, factor area presenting section 160 presents, as incident/potential-incident factor areas, the unnoticed area and the over-noticed area so as to be distinguished from each other by different colors or the like. That is, in the present embodiment, factor area presenting section 160 displays the incident/potential-incident factor areas for the respective factors so as to be overlapped on the map data of the intersection.

Figure 11:
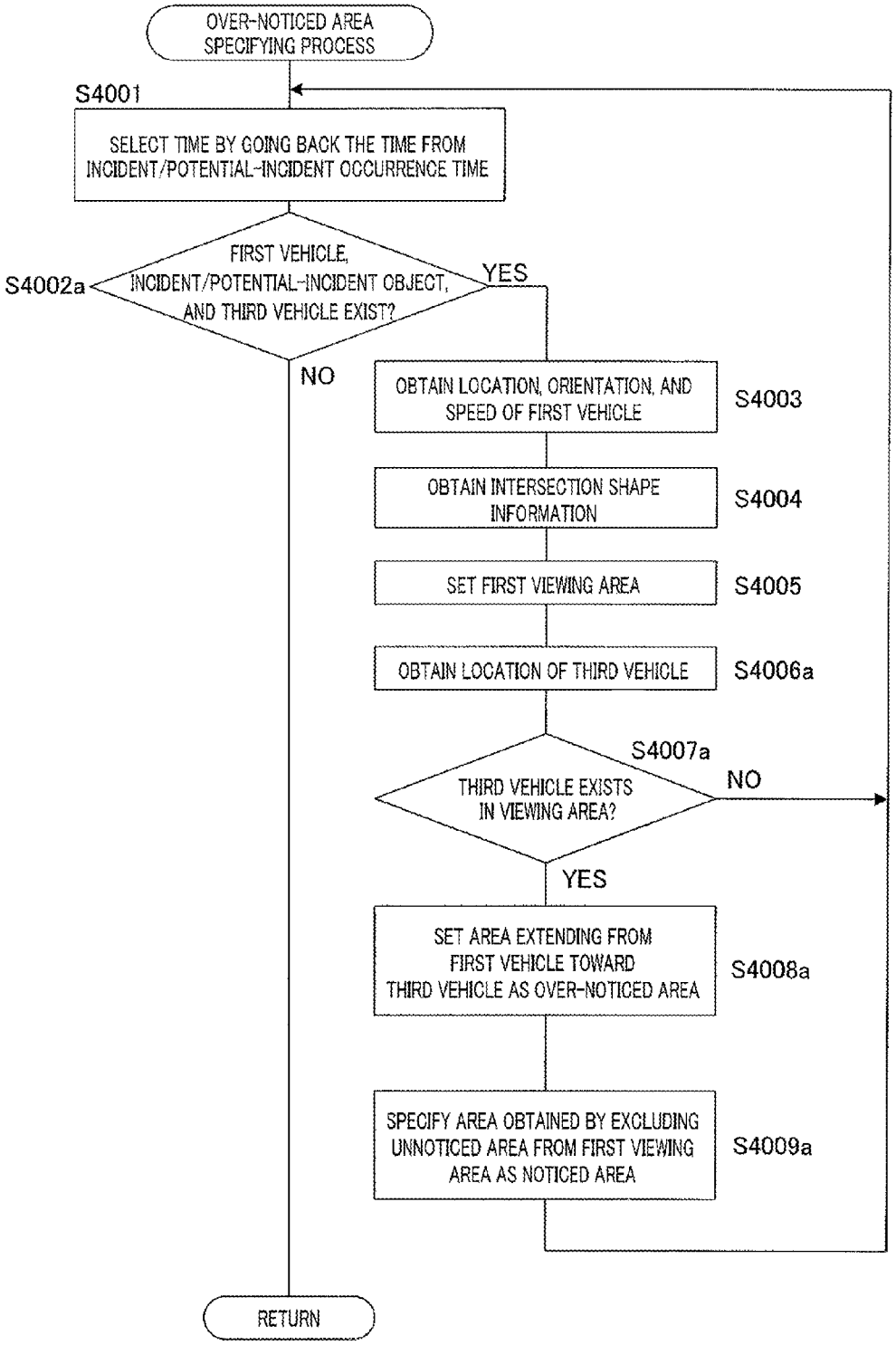
FIG. 11 is a flowchart showing an example of over-noticed area specifying process in Embodiment 2.

FIG. 11 is a flowchart showing an example of the over-noticed area specifying process (step 4100*a*). The over-noticed area specifying process is partly the same as the unnoticed area specifying process described with reference to FIG. 6 of Embodiment 1. Therefore, the same step numbers are designated to the same processes as those in FIG. 6, and the description will be omitted appropriately.

First, over-noticed area specifying section 153*a* selects time (S4001) and, if the first vehicle, the incident/potential-incident object, and the third vehicle are present in an intersection (YES in S4002*a*), proceeds to step S4003. Over-noticed area specifying section 153*a* executes the processes in steps S4003 to S4005 to set the first viewing area.

It is assumed that over-noticed area specifying section 153*a* handles, as a third vehicle, a vehicle which encounters with the first vehicle and the incident/potential-incident object in any intersection and at any time. To simplify the description, it is assumed that at most one third vehicle exists as an analysis object.

Over-noticed area specifying section 153*a* obtains the location of the third vehicle at the selected time from the time-series data (S4006*a*) and determines whether the third vehicle exits in the set first viewing area or not (S4007*a*). If there is no third vehicle in the first viewing area (NO in S4007*a*), over-noticed area specifying section 153*a* returns to step S4001.

If the third vehicle exists in the first viewing area (YES in S4007*a*), the process proceeds to step S4008*a*. Over-noticed area specifying section 153*a* sets, as an over-noticed area, an area in the first viewing area and on the inside of a line segment connecting the positions at both ends of the third vehicle (over-noticed object) which can be visually recognized from the first vehicle and the position of the first vehicle (S4008*a*). Over-noticed area specifying section 153*a* may set, as the over-noticed area, the entire area extending in a direction from the position of the first vehicle toward the position of the third vehicle in the first viewing area. Alternately, over-noticed area specifying section 153*a* may set, as an over-noticed area, only the area up to the area where the third vehicle is located, in the direction from the position of the first vehicle to the position of the third vehicle.

Over-noticed area specifying section 153*a* specifies, as a noticed area, an area obtained by excluding the unnoticed area from the first viewing area (S4009*a*). After that, over-noticed area specifying section 153*a* returns to step S4001.

If any of the first vehicle, the incident/potential-incident object, and the third vehicle does not exist in the intersection as the potential-incident occurrence location (NO in S4002*a*), over-noticed area specifying section 153*a* specifies the incident/potential-incident factor area on the basis of the set noticed area.

Over-noticed area specifying section 153*a* may set the over-noticed area at each time as the incident/potential-incident factor area (that is, an over-noticed area) at the time. Over-noticed area specifying section 153*a* may set an area obtained through the logical OR operation on the over-noticed areas at respective time points in a continuous time zone, as the incident/potential-incident factor area in a time zone just before a potential incident. Over-noticed area specifying section 153*a* may set an area obtained through the logical OR operation on the over-noticed areas at respective time points in discrete time points or time zones (for example, the same time point or time zone in different days), as an incident/potential-incident factor area in a time zone just before a potential incident. Over-noticed area specifying section 153*a* may set an area obtained through the logical OR operation on all of the over-noticed areas obtained in time series as the incident/potential-incident factor area in a time zone just before a potential incident. Over-noticed area specifying section 153*a* may set, as an incident/potential-incident factor area, an area where a time integral of a time period of the existence of the over-noticed area in a continuous time zone or in discrete time points or time zones is a predetermined value or larger. Over-noticed area specifying section 153*a* may set, as an incident/potential-incident factor area in a time zone just before a potential incident, only the over-noticed area at any time.

As described above, if a third vehicle different from an incident/potential-incident object is present in the first viewing area just before a potential incident, incident/potential-incident factor area specifying apparatus 100*a* according to the present embodiment sets the area corresponding to the location of the third vehicle, as an over-noticed area. Incident/potential-incident factor area specifying apparatus 100*a* presents, as the incident/potential-incident factor areas, the unnoticed area and the over-noticed area so as to be distinguished from each other. In such a manner, incident/potential-incident factor area specifying apparatus 100*a* can call for attention or present a potentially dangerous area with respect to a potential incident caused by another area to which too much attention is paid.

Incident/potential-incident factor area specifying apparatus 100*a* may detect a plurality of third vehicles, set a plurality of candidates of over-noticed areas, and specify one or more over-noticed areas from the candidates. In this case for example, over-noticed area specifying section 153*a* sets the size of each of the over-noticed areas as the degree of over-notice, and arranges the over-noticed areas in descending order of the degree of over-notice. The over-notice area specifying section 153*a* controls the number of over-noticed areas which can be recognized according to the speed of the vehicle by using the degree of over-notice and outputs the over-notice areas as an incident/potential-incident factor area, to factor area presenting section 160.

Embodiment 3

The area which is likely to be a factor of a potential incident also includes an area in which an incident/potential incident object existed in a blind area as the blind area of the first vehicle (hereinbelow, called "factor blind area"). An incident/potential-incident factor area specifying apparatus according to Embodiment 3 of the present invention presents the unnoticed area and the factor blind area as incident/potential-incident factor areas.

Figure 12:
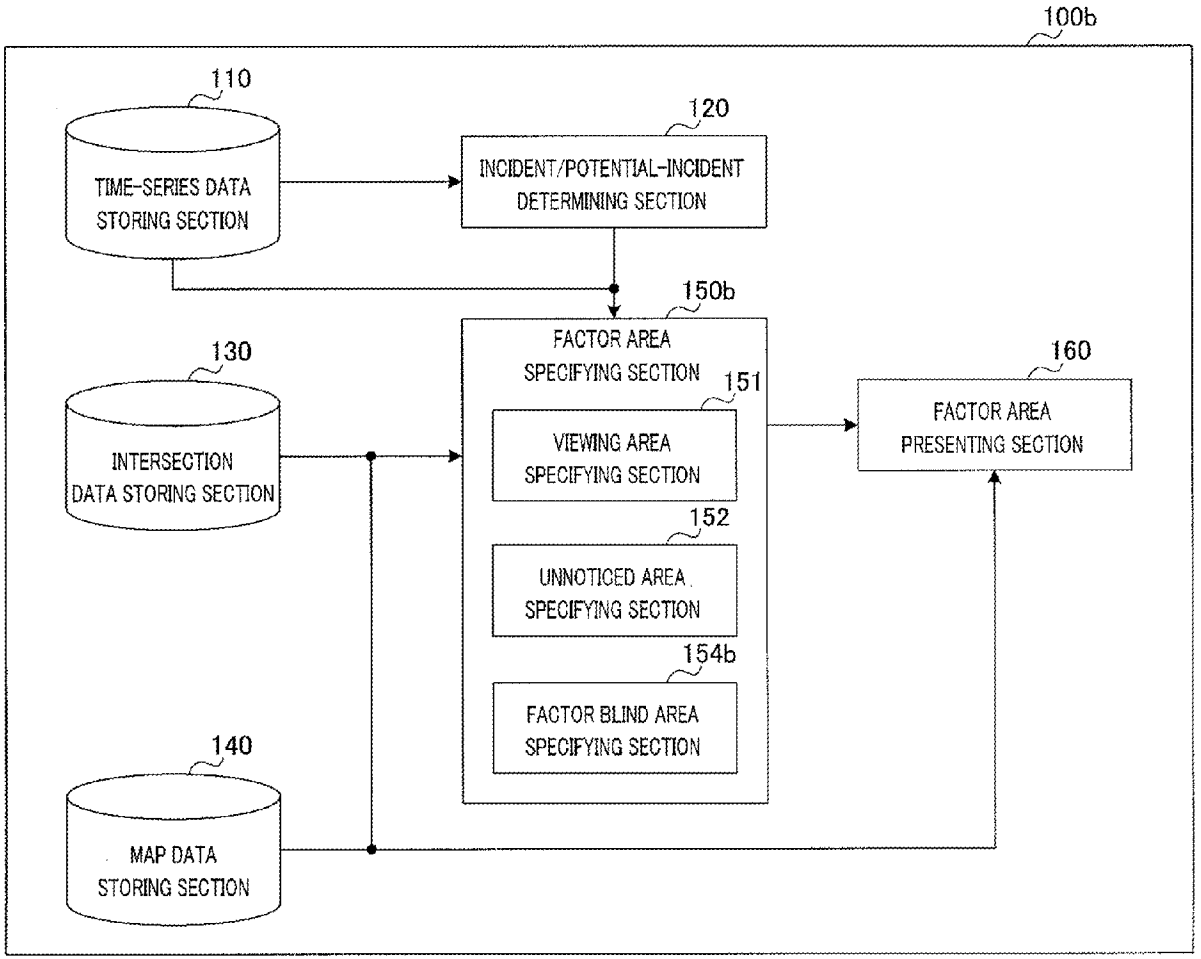
FIG. 12 is a block diagram illustrating an example of the configuration of an incident/potential-incident factor area specifying apparatus according to Embodiment 3 of the present invention.

FIG. 12 is a block diagram illustrating an example of the configuration of the incident/potential-incident factor area specifying apparatus according to Embodiment 3 of the present invention and corresponds to FIG. 1 of Embodiment 1. The same reference numerals are designated to the same parts as those of FIG. 1, and their description will not be repeated.

In FIG. 12, factor area specifying section 150*b* of incident/potential-incident factor area specifying apparatus 100*b* according to the present embodiment newly has factor blind area specifying section 154*b*.

If an incident/potential-incident object is located in a blind area which cannot be seen from the driver of the first vehicle due to a building or the like in the periphery, factor blind area specifying section 154*b* specifies the area corresponding to the blind area as a factor blind area. Factor blind area specifying section 154*b* outputs the factor blind area as an incident/potential incident factor area to factor area presenting section 160.

Figure 13:
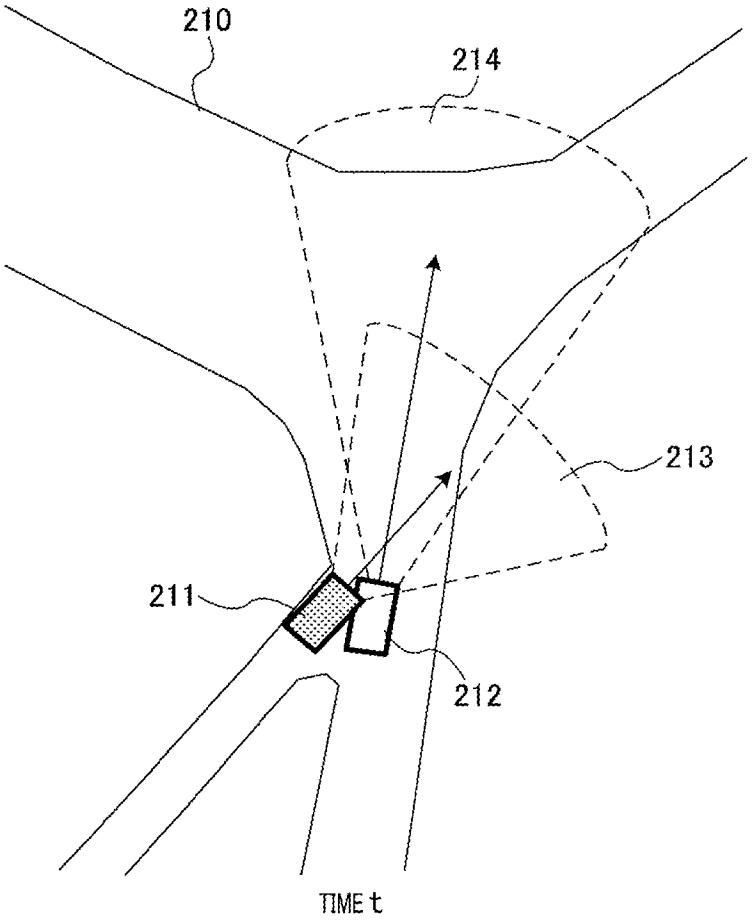
FIG. 13 is a first schematic view for explaining a factor blind area in Embodiment 3.
Figure 14:
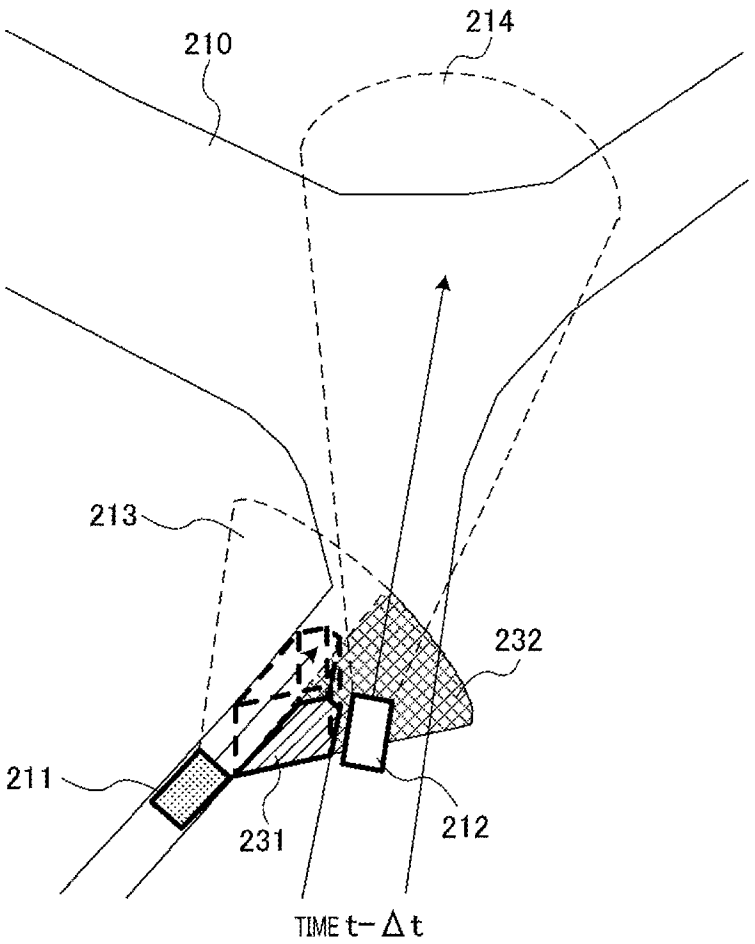
FIG. 14 is a second schematic view for explaining a factor blind area in Embodiment 3.

FIGS. 13 and 14 are schematic views for explaining a factor blind area and correspond to FIGS. 2 and 3 of Embodiment 1. The same reference numerals are designated to the same components as those of FIGS. 2 and 3, and their description will not be repeated. The positions and orientations of the first and second vehicles are different from those of FIGS. 2 and 3.

FIG. 13 illustrates a state where a potential incident occurs at time t=1. FIG. 14 illustrates a scene in which blind area 232 was present due to building 231 in first viewing area 213 at immediately preceding time t−Δt. It is assumed that second vehicle 212 as an incident/potential-incident object was located in blind area 232. In this case, if the driver of first vehicle 211 is aware of the possibility of the presence of second vehicle 212 in blind area 232, the possibility of preventing the potential incident is high.

If second vehicle 212 is located in blind area 232 existing in first viewing area 21.3 at time t−Δt just before a potential incident, incident/potential-incident factor area specifying apparatus 100*b* sets blind area 232 as a factor blind area. Incident/potential-incident factor area specifying apparatus 100*b* presents the factor blind area as the incident/potential-incident factor area.

Figure 15:
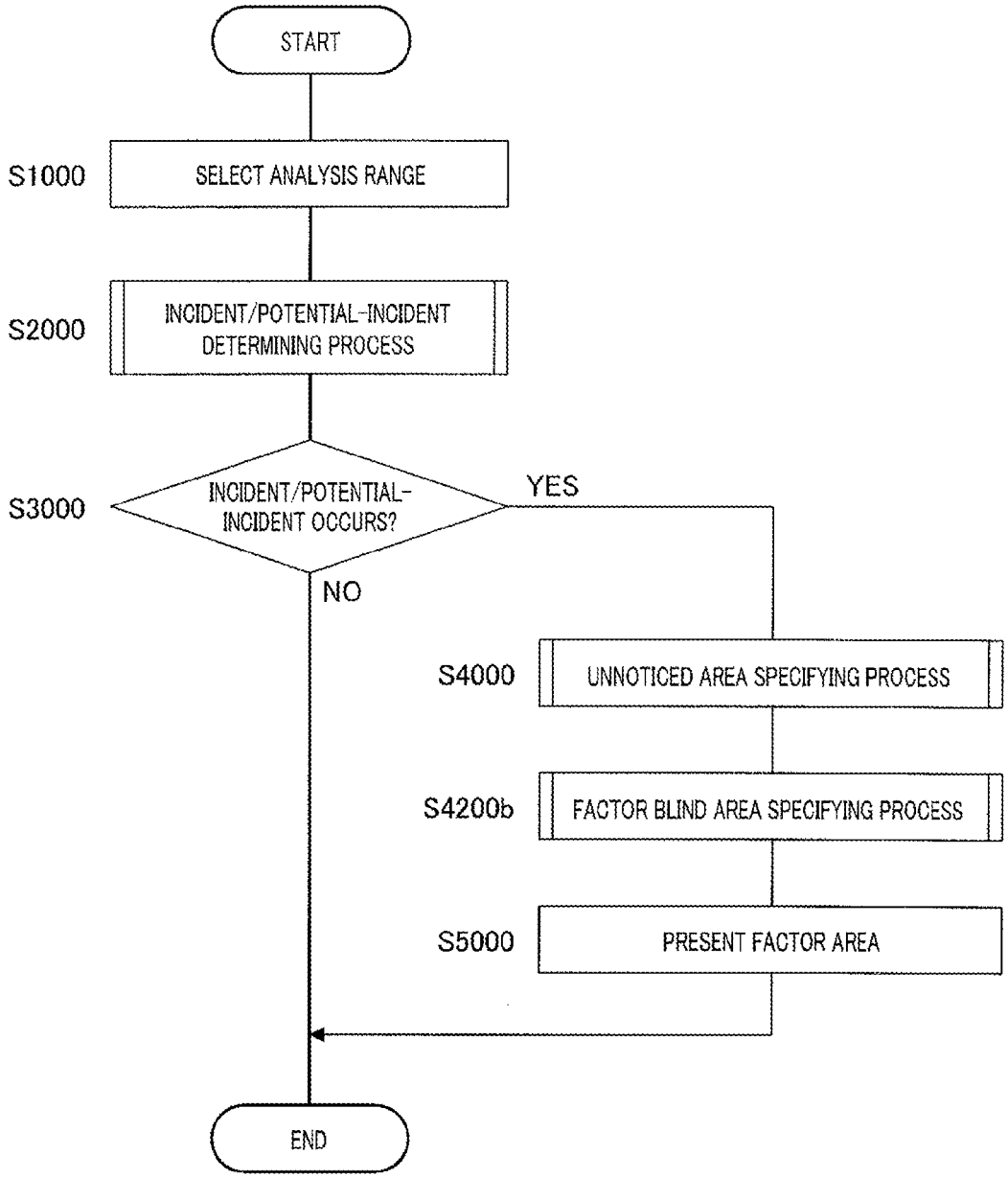
FIG. 15 is a flowchart showing an example of operations of a factor area specifying apparatus according to Embodiment 3.

FIG. 15 is a flowchart showing an example of operations of the incident/potential-incident factor area specifying apparatus according to the present embodiment and corresponds to FIG. 4 of Embodiment 1. The same reference numerals are designated to the same components as those of FIG. 4, and their description will not be repeated.

If the unnoticed area is specified in step S4000, factor blind area specifying section 154*b* executes a factor blind area specifying process of specifying a factor blind area in step S4200*b*. The details of the process will be described later.

In the present embodiment, factor area presenting section 160 presents, as incident/potential-incident factor areas, the unnoticed area and the factor blind area so as to be distinguished from each other by different colors or the like. That is, in the present embodiment, factor area presenting section 160 displays the incident/potential-incident factor areas for the respective factors so as to be overlapped on the map data of the intersection.

Figure 16:
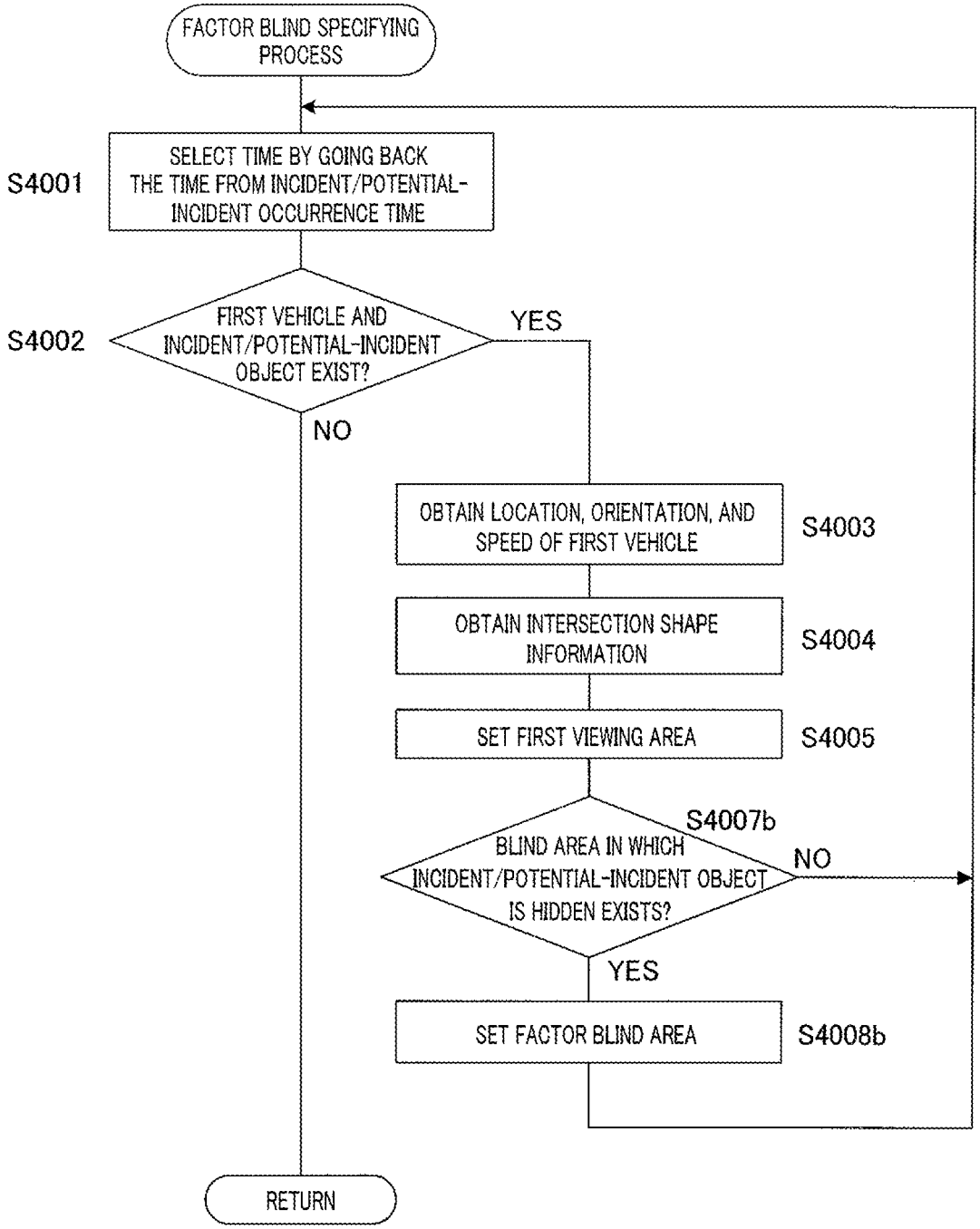
FIG. 16 is a flowchart showing an example of factor blind area specifying process in Embodiment 3.

FIG. 16 is a flowchart showing an example of the factor blind area specifying process (step 4200*b*). The factor blind area specifying process is partly the same as the unnoticed area specifying process described with reference to FIG. 6 of Embodiment 1. Therefore, the same step numbers are designated to the same processes as those in FIG. 6, and the description will be omitted appropriately.

First, factor blind area specifying section 154*b* executes the processes in steps S4003 to S4005 to set the first viewing area at all of time points when the first vehicle and the incident/potential-incident object are present in the intersection.

Factor blind area specifying section 154*b* determines whether a blind area in which an incident/potential-incident object is hidden exists or not.

The presence/absence of the blind area is determined by, for example, as follows. First, from intersection data, factor blind area specifying section 154*b* retrieves an incidental facility and a building positioned between the first vehicle and the incident/potential-incident object, and obtains the information of the positions and the areas of them. Factor blind area specifying section 154*b* sets an area over the building and the like when viewed from the first vehicle, in the first viewing area as a blind area in which an incident/potential-incident object is hidden.

If a blind area in which an incident/potential-incident object is hidden is absent (NO in S4007*b*), factor blind area specifying section 154*b* returns to step S4001. On the other hand, if a blind area in which an incident/potential-incident object is hidden is present (YES in S4007*b*), factor blind area specifying section 154*b* sets the blind area as the factor blind area (S4008*b*) and returns to step S4001.

Factor blind area specifying section 154*b* may set the factor blind area at each time as the incident/potential-incident factor area at the time. Factor blind area specifying section 154*b* may set an area obtained through the logical OR operation on all of factor blind areas obtained in time series, as the incident/potential-incident factor area in a time zone just before a potential incident. Factor blind area specifying section 154*b* may set, as an incident/potential-incident factor area, an area where a time integral of a time period of the existence of the factor blind area is a predetermined value or larger. Factor blind area specifying section 154*b* may set, as an incident/potential-incident factor area in a time zone just before a potential incident, only the factor blind area at any time.

As described above, if an incident/potential-incident object is present in the blind area of the first vehicle just before a potential incident, incident/potential-incident factor area specifying apparatus 100*b* according to the present embodiment specifies the blind area as a factor blind area. Incident/potential-incident factor area specifying apparatus 100*b* presents, as the incident/potential-incident factor areas, the unnoticed area and the factor blind area so as to be distinguished from each other. In such a manner, incident/potential-incident factor area specifying apparatus 100*b* can call for attention or present a potentially dangerous area with respect to a potential incident caused by not paying attention to the factor blind area. Incident/potential-incident factor area specifying apparatus 100*b* may further include over-noticed area specifying section 153*a* of Embodiment 2 and present also an over-noticed area as the incident/potential-incident factor area.

The method of specifying the first viewing area is not limited to the methods (shape, calculation equation, and parameters of setting) described in the foregoing embodiments. For example, the incident/potential-incident factor area specifying apparatus may change a viewing area in accordance with the age of the driver, individually set parameters related to the viewing area, and feedback a parameter from measurement values related to the visual sense of the driver, the position of the head, operation, and the like. The incident/potential-incident factor area specifying apparatus may preliminarily obtain the direction in which the driver intends to drive, from the information of winkers and behavior of the vehicle and change the shape of the viewing area in accordance with the obtained direction. In this case, for example, the incident/potential-incident factor area specifying apparatus may set a shape having a center in the direction in which the driver intends to drive, instead of a shape having a center along the velocity vector of the vehicle.

The occurrence of a potential incident is not limited to the above-described one. For example, the incident/potential-incident factor area specifying apparatus may determine, as occurrence of a potential incident, for example, disobedience of traffic regulation such as ignorance of a traffic light or stop sign violation, abrupt acceleration, accidental contact, and occurrence of an incident.

The method of determining the over-noticed area is not limited to the above-described one. For example, when a plurality of candidates of over-noticed areas area set, the incident/potential-incident factor area specifying apparatus may employ an attribute other than the size of the over-noticed area as the degree of over-notice. Such an attribute is, for example, distance from an unnoticed area, the number of vehicles in the over-noticed area, the number of vehicles driving in the over-noticed area, the number of vehicles stopped in the over-noticed area, the number of vehicles driving in the viewing area, or the number of vehicles stopped in the viewing area.

The incident/potential-incident factor area specifying apparatus does not always have to have the time-series data storing section, the intersection data storing section, the map data storing section, and the factor area presenting section. In this case, for example, the incident/potential-incident factor area specifying apparatus obtains data from an external information server via a communication network, and outputs information of the incident/potential-incident factor area to an external display apparatus. When the occurrence place and occurrence time of a potential incident are clear, the incident/potential-incident factor area specifying apparatus does not have to have the incident/potential-incident determining section.

The object which can be a cause of a potential incident is not limited to a vehicle. For example, objects to be noticed include a pedestrian, a traffic light, and a sign. For example, when a traffic light stands in a location where it is not easily seen, although it exists in the viewing area, there is the possibility that the driver misses the red light and a potential incident occurs. When the present invention is applied to such a case, it is understood that the area corresponding to the position of the traffic light is the incident/potential-incident factor area (unnoticed area).

The incident/potential-incident factor area specifying apparatus according to each of the foregoing embodiments can provide the incident/potential-incident factor area as incident prediction information, incident statistical information, and incident analysis information to a driver, a road administrator who performs safety design and improvement of roads, a police officer who makes an inspection of a traffic incident and a traffic safety campaign, an incident appraiser conducting an incident analysis, an insurer making an incident analysis, and the like.

The disclosure of Japanese Patent Application No. 2010-223889, filed on Oct. 1, 2010, including the specification, drawings and abstract, is incorporated herein by reference in its entirety.

INDUSTRIAL APPLICABILITY

The present invention is useful as an incident/potential-incident factor area specifying apparatus and an incident/potential-incident factor area specifying method capable of specifying an incident/potential-incident factor area which has to be surely presented. That is, the present invention is suitable for a preventive safety system, a drive assist system, a traffic incident preventing system particularly for an intersection, a traffic incident factor analysis system, and a traffic incident predicting system.

REFERENCE SIGNS LIST

100, 100*a*, 100*b* Incident/potential-incident factor area specifying apparatus
110 Time-series data storing section
120 Incident/potential-incident determining section
130 Intersection data storing section
140 Map data storing section
150, 150*a*, 150*b* Factor area specifying section
151 Viewing area specifying section.
152 Unnoticed area specifying section
153*a* Over-noticed area specifying section
154*b* Factor blind area specifying section
160 Factor area presenting section

The invention claimed is:

1. An incident/potential-incident factor area specifying apparatus that specifies one or more incident/potential-incident factor areas to be noticed by a driver of a vehicle in order to prevent an incident and a potential incident, comprising:

a viewing area specifying section that specifies a viewing area of a driver of a vehicle for which an incident or a potential incident has occurred, the viewing area being the driver's viewing area just before the incident or the potential incident; and an unnoticed area specifying section that, if an object of the incident or the potential incident is located in the viewing area, sets an area corresponding to a location of the object, as an unnoticed area that is one of the incident/potential-incident factor areas.

2. The incident/potential-incident factor area specifying apparatus according to claim 1, further comprising an over-noticed area specifying section that, if the object of the incident or the potential incident is located in the viewing area and another object that is likely to be noticed by the driver is located in the viewing area, sets an area corresponding to the location of the other object as an over-noticed area that is one of the incident/potential-incident factor areas.

3. The incident/potential-incident factor area specifying apparatus according to claim 1, further comprising a factor area presenting section that displays the incident/potential-incident factor area so as to be overlapped on map data.

4. The incident/potential-incident factor area specifying apparatus according to claim 1, wherein the viewing area specifying section specifies the viewing area on the basis of time-series data as record of a driving state of the vehicle.

5. The incident/potential-incident factor area specifying apparatus according to claim 1, further comprising an incident/potential-incident determining section that determines presence/absence of occurrence of the incident or the potential incident of the vehicle and specifies occurrence time and the object of the incident or the potential incident on the basis of time-series data as record of a driving state of the vehicle.

6. The incident/potential-incident factor area specifying apparatus according to claim 5, wherein the incident/potential-incident determining section specifies the object of the incident or the potential incident of the vehicle on the basis of a time-series data as record of a driving state of another vehicle.

7. The incident/potential-incident factor area specifying apparatus according to claim 5, wherein the incident/potential-incident determining section determines that the incident or the potential incident of the vehicle occurs at time when at least one of acceleration and course of the vehicle changes drastically.

8. The incident/potential-incident factor area specifying apparatus according to claim 1, further comprising a factor blind area specifying section, that if the object of the incident or the potential incident of the vehicle is already located in the viewing area and also located in a blind spot of the driver, sets an area corresponding to the blind spot as a factor blind area that is one of the incident/potential-incident factor areas.

9. The incident/potential-incident factor area specifying apparatus according to claim 1, wherein the viewing area specifying section specifies the viewing area in time unit, and the unnoticed area specifying section specifies the unnoticed area in time unit.

10. An incident/potential-incident factor area specifying method of specifying one or more incident/potential-incident factor area to be noticed by a driver of a vehicle in order to prevent an incident and a potential incident, comprising:

a step of specifying a viewing area of a driver of a vehicle for which an incident or a potential incident has occurred, the viewing area being the driver's viewing area just before the incident or the potential; and a step, if an object of the incident or the potential incident is located in the viewing area, of setting an area corresponding to a location of the object, as an unnoticed area that is one of the incident/potential-incident factor areas.

* * * * *